US007472860B2

(12) United States Patent
Niskanen

(10) Patent No.: US 7,472,860 B2
(45) Date of Patent: Jan. 6, 2009

(54) METHOD FOR WINDING A BOARD, PAPER OR MATERIAL WEB AND A WINDER FOR A PAPER, BOARD OR MATERIAL WEB

(75) Inventor: Heikki Niskanen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 327 days.

(21) Appl. No.: 10/569,568

(22) PCT Filed: Aug. 24, 2004

(86) PCT No.: PCT/FI2004/000495

§ 371 (c)(1),
(2), (4) Date: Feb. 27, 2006

(87) PCT Pub. No.: WO2005/021412

PCT Pub. Date: Mar. 10, 2005

(65) Prior Publication Data

US 2006/0261209 A1 Nov. 23, 2006

(30) Foreign Application Priority Data

Aug. 29, 2003 (FI) ..... 20031218

(51) Int. Cl.
*B65H 18/08* (2006.01)

(52) U.S. Cl. ..... 242/530.1; 242/542; 242/598

(58) Field of Classification Search ..... 242/530.1, 242/542, 598
See application file for complete search history.

(56) References Cited

U.S. PATENT DOCUMENTS

| | | | | |
|---|---|---|---|---|
| 1,954,610 | A | 4/1934 | Bebie | |
| 3,990,648 | A | 11/1976 | Justus et al. | |
| 4,431,141 | A | 2/1984 | Schutz | |
| 4,739,945 | A | 4/1988 | Yokoe | |
| 5,441,780 | A | 8/1995 | Bushell et al. | |
| 5,845,871 | A | 12/1998 | Lynch et al. | |
| 5,908,171 | A | 6/1999 | Raudaskoski | |
| 6,706,133 | B1 | 3/2004 | Erkkilä | |
| 7,011,267 | B2 * | 3/2006 | Koutonen et al. | 242/530.1 |
| 2004/0056142 | A1 | 3/2004 | Koutonen et al. | |

FOREIGN PATENT DOCUMENTS

| | | |
|---|---|---|
| DE | 93 20 546.5 U1 | 9/1994 |
| DE | 94 18 081 U1 | 4/1996 |
| DE | 0 792 245 | 3/1997 |
| FI | 103103 B | 4/1999 |

(Continued)

OTHER PUBLICATIONS

Search Report issued in FI 20031218, 2003.

(Continued)

*Primary Examiner*—Sang Kim
(74) *Attorney, Agent, or Firm*—Stiennon & Stiennon

(57) ABSTRACT

A paper, board or material web is wound in a winder of the two-drum type. Winding core (10) ends placed against each other are coupled to be on the same axis of rotation during winding by severing cuts (12U, 12N) which are formed in the ends (11A, 11B) of the winding cores (10) and which deviate from a perpendicular cutting line.

9 Claims, 3 Drawing Sheets

FOREIGN PATENT DOCUMENTS

| | | | |
|---|---|---|---|
| FI | 104551 | B | 2/2000 |
| FI | 20002679 | | 12/2000 |
| JP | 1-220663 | | 9/1989 |
| WO | WO 93/10033 | A1 | 5/1993 |
| WO | WO 97/16367 | A1 | 5/1997 |
| WO | WO 03/004393 | A1 | 1/2003 |
| WO | WO 03/082718 | A1 | 10/2003 |
| WO | WO 2005/021412 | A1 | 3/2005 |

OTHER PUBLICATIONS

International Search Report issued in PCT/FI2004/000495, 2004.

* cited by examiner

METHOD FOR WINDING A BOARD, PAPER OR MATERIAL WEB AND A WINDER FOR A PAPER, BOARD OR MATERIAL WEB

CROSS REFERENCES TO RELATED APPLICATIONS

This application is a U.S. national stage application of International App. No. PCT/FI2004/000495, filed Aug. 24, 2004, the disclosure of which is incorporated by reference herein, and claims priority on Finnish App. No. 20031218, filed Aug. 29, 2003.

STATEMENT AS TO RIGHTS TO INVENTIONS MADE UNDER FEDERALLY SPONSORED RESEARCH AND DEVELOPMENT

Not Applicable

BACKGROUND OF THE INVENTION

The invention relates to a method for winding a paper, board or material web on a winder of the two-drum type, and to a method for manufacturing a winding core for a winder, and a winding core for a winder.

In the prior art, slitter-winders are known in which winding takes place on winding drums after the slitting of a paper, board or material (e.g. plastic, aluminium, etc.) web. In winders of the two-drum type, slit component webs are wound around a winding core, e.g. a roll core, on support of two drums or one drum and a set of drums or two sets of drums. In the following description and claims, for the sake of simplicity, the term winding drum is used when referring to a carrier drum/a set of carrier drums in a winder of the two-drum type, i.e. including the meanings of both a winding drum and a set of winding drums. In addition, in the following description the term roll core is also partly used in the general sense 'winding core', i.e. by the term roll core is meant a winding core that is made of paper, board, glass fibre, metal, plastic, or the like.

In two-drum winders, in which narrower component webs slit with slitter blades from a web unwound from a machine reel are wound into customer rolls, the rolls are usually placed side by side on two winding drums. Because of variations in the cross-direction profiles, for example, thickness, moisture, roughness or friction, of the web to be wound, adjacent rolls are not always formed with precisely equally large diameters, in spite of the fact that precisely equally long component webs are wound into them. Owing to the different diameters of the rolls, the winding cores placed in the roll centers are displaced with the progress of winding in relation to one another so that their centers of rotation are separated and, at the same time, variations also occur in the angular speeds of the rolls. Because of this detrimental phenomenon there occurs vibration in two-drum winding, with the result that it is necessary to limit speed, i.e. to be content with a lower winding speed, which reduces the capacity of the machine and is, thus, uneconomical.

The problem described above has occurred as long as winders of the two-drum type have been constructed without a shaft, i.e. inside roll cores there is no shaft that couples them together. The seriousness of the problem has, however, varied in the course of the years, because the profile of the web produced on the paper machine has improved and a limited running speed has been accepted on the slitter-winder. In recent years, the diameters of the customer rolls produced have started becoming ever larger and, at the same time, the machine widths and the winding speeds have also increased, for which reason the problem of vibration has been noticed again: even a small variation of profile in the direction of width of the web is cumulated especially during winding of thin paper grades so that faults in the shape of the rolls which arise from the web profile cause a significant vibration problem.

In the winding process, a number of different phenomena are effective which attempt to shift the web rolls that are being formed in their axial direction:

- deflection of winding cylinders, i.e. winding drums,
- faults in the shape of the rolls arising from uneven profile of the web, and
- also the core chucks, which support the winding cores of the outermost web rolls, subject the row of rolls to axial forces when they keep the row of rolls in the desired position.

One problem in winding is also that the length of the winding cores, for example, roll cores, changes during winding because the compression pressure caused by the winding of the web onto the roll core causes widening of the wound web and elongation of roll cores.

The core chucks alone can also produce a compression force acting on the whole row of winding cores if the winding cores are excessively long: the total length of the winding cores is greater than the regulated distance between the core chucks.

When a paper or board web is wound around a roll core, in two-drum or carrier belt slitting the rolls and the roll cores are in a row and they are kept in place in the axial direction by means of core chucks. If there are cross direction thickness variations in the web, the rolls will have different diameters and, consequently, the roll cores are no longer on the same axis of rotation. This readily leads to the bouncing of rolls and the running speed must be lowered. In some places the situation has been helped by disposing sleeves between the roll cores to couple the roll cores together for the time of winding. However, the use of them causes additional work and makes the separation of the rolls more difficult after the winding.

One problem is that if the circumference of a roll changing in a winder is round in its outer surface but the roll core is not located at the centre line, this makes converting more difficult in which the roll is again supported at the center, because in such a case the roll starts to bounce. This also causes problems in that in converting, for example, in printing houses where roll change is accomplished as a flying splice change, the alignment of the web is generally monitored based on the edge and if the roll has not been formed properly in respect of the center, there will be a displacement of the web at the splice in connection with splicing.

In the course of the years, the rolls have become larger in size, diameter has increased and width has grown and, along with it, it has been necessary to make the roll cores still harder. Since during tight winding the roll cores nevertheless elongate, this elongation cumulates in the edge rolls and against the core chucks. To prevent the increase of the axial force of the roll chucks, the core chucks have been provided with flexibility but it increases the dishing of the edge rolls. Roll dishing occurs when a contracted web under tension is wound. The tension changes into a compression stress inside the roll, with the result that the web tends to become wider. This causes that the rolls push one another. The widening cumulates from the middle towards the edges.

The problems described above are most difficult when winding a web that has high compressibility and a high friction coefficient. Such web grades include, for example, DIP newsprint which is recycled fiber based newsprint, and sack paper. The degree of seriousness of the problem is affected, among other things, by where the recycled paper is derived from, what kind of deinking method has been used in its cleaning and what properties the recycled paper has.

With respect to the prior art, reference may be made to FI patent application 20002679, which discloses a method and a device for winding a paper or board web and proposes an arrangement for the problems described above and, in particular, for determining the compression pressure and the position of core chucks in the winding process, in which arrangement measuring devices for measuring the position and the force of the chuck as well as machine controls for controlling the core chuck are arranged in connection with the core chuck such that the position and/or the force of the chucks is in a desired value range, i.e. within desired limits, and no harmful vibration is generated because of axial thrust forces of detrimental magnitude between the winding cores. It is stated that in this method according to the invention it is novel and inventive that in the method the winding cores are placed in a desired position and subjected to a desired compression force by means of the core chucks, the length of the row of the winding cores is determined and the compression force of at least one core chuck is regulated during winding when the length of the row of the winding cores changes to keep the compression force and/or the length of the winding core row within desired limits.

With respect to the prior art, reference may also be made to FI patent No. 103103, which discloses a method in winding, wherein a number of separate rolls are formed around separate winding cores placed one after the other while supported by support members, in an attempt to solve the problems described above, in particular in connection with different vibration problems. It is stated that a new idea in this method is that, in order to reduce the friction coefficient of the winding cores, before, or at the same time as, the winding cores are placed in the winding position, the ends of the winding cores are treated with an agent that reduces the friction coefficient, or a piece of a material that has a low friction coefficient is placed at the ends of the winding cores, and/or the axial thrust force between the winding cores is lowered by passing a pressurized medium through the core chucks and allowing it to discharge from between the winding cores.

SUMMARY OF THE INVENTION

One object of this invention is to create a novel arrangement that can be made use of with the prior art arrangements described above or as a separate system to eliminate or at least minimize the problems described above.

In accordance with the invention, at least one severing cut that deviates from a perpendicular cutting line is made in the ends of winding cores to be placed in end-to-end relationship or in the ends of pieces attached to the ends of a winding core, and a mating cut for the severing cut is made in the end of a winding core, for example, a roll core which is in end-to-end relationship with it.

The severing cut that deviates from a perpendicular cutting line in accordance with the invention is made either directly in the core material in the end of the winding core, i.e. the roll core, or in a separate piece attached to the end of the roll core. This severing cut can be made, for example, in connection with the sawing of the roll core by turning on a lathe, milling/cutting, grinding, heating, pressing or swaging.

In accordance with the invention, a severing cut deviating from a perpendicular cutting line is formed in the ends of the winding core, or the roll core, i.e. grooves which are so placed that the ends of the roll cores to be placed in end-to-end relationship have a male and a female grooving against each other, that is, a cut that deviates from a perpendicular cutting line and a cut of its desired mating shape. In the roll cores placed against one another in the winding process, there is a male grooving at the end of one roll core and a female grooving at the end of the other roll core. When the core chucks are locked and winding is started, the roll cores are coupled to one another, whereby the roll cores remain on the same axis of rotation during winding, which means that no stepped diameter differences between the rolls can arise. Hence, the rolls also do not start to bounce. From the foregoing it also follows that between the rolls no stepped diameter differences can arise that limit the running speed.

In accordance with the invention, at least one severing cut that deviates from a perpendicular cutting line is made in the end of the winding core, i.e. the roll core, but there can also be more cuts, that is, grooving is formed of at least one groove or a part of it (a diagonal cut). The depth of the grooving is advantageously 0.5-5 mm deep and thus such that it couples the roll cores together but does not prevent the rolls from being separated from one another on the floor after winding. The shape of the severing cut can be a broken line, a wavy line or another appropriate shape, for example, an oblique surface.

In accordance with one advantageous additional feature of the invention, the depth of the severing cuts (male-female) which deviate from a perpendicular cutting line and are placed against each other, is formed such that they do not fully correspond to each other but the grooves of the winding cores, or roll cores, to be placed against each other are not mirror images of each other, but, instead, the grooves of one side are unequal in depth. By this means, axial play is provided between the roll cores. When the roll cores elongate during winding, this elongation disappears in the ends of the roll core because of this allowance for longitudinal yielding without it being cumulated in the edge rolls. Thus, roll dishing and the axial force of the chuck are reduced. This also provides the advantage that when the roll becomes wider during winding the sides of the roll are able to lean against one another, which leads to a more stable winding process and neater roll sides at high running speeds. The allowance for longitudinal yielding, i.e. the longitudinal yield limit in mating cuts of different depths, can be, for example, 0.5-2 mm.

The invention is suitable for use in connection with all different roll core sizes and for all wound webs. It is particularly advantageous when winding a material that has high compressibility and a high friction coefficient, for example, DIP newsprint and sack paper.

In the following, the invention will be described in greater detail with reference to the figures in the appended drawing, but the invention is by no means meant to be narrowly limited to the details of the FIGURES.

BRIEF DESCRIPTION OTHE DRAWINGS

FIGS. 1A-1D show four different alternatives for severing cut shapes of a roll core end.

DESCRIPTION OF THE PREFERRED EMBODIMENTS

Figure 3:
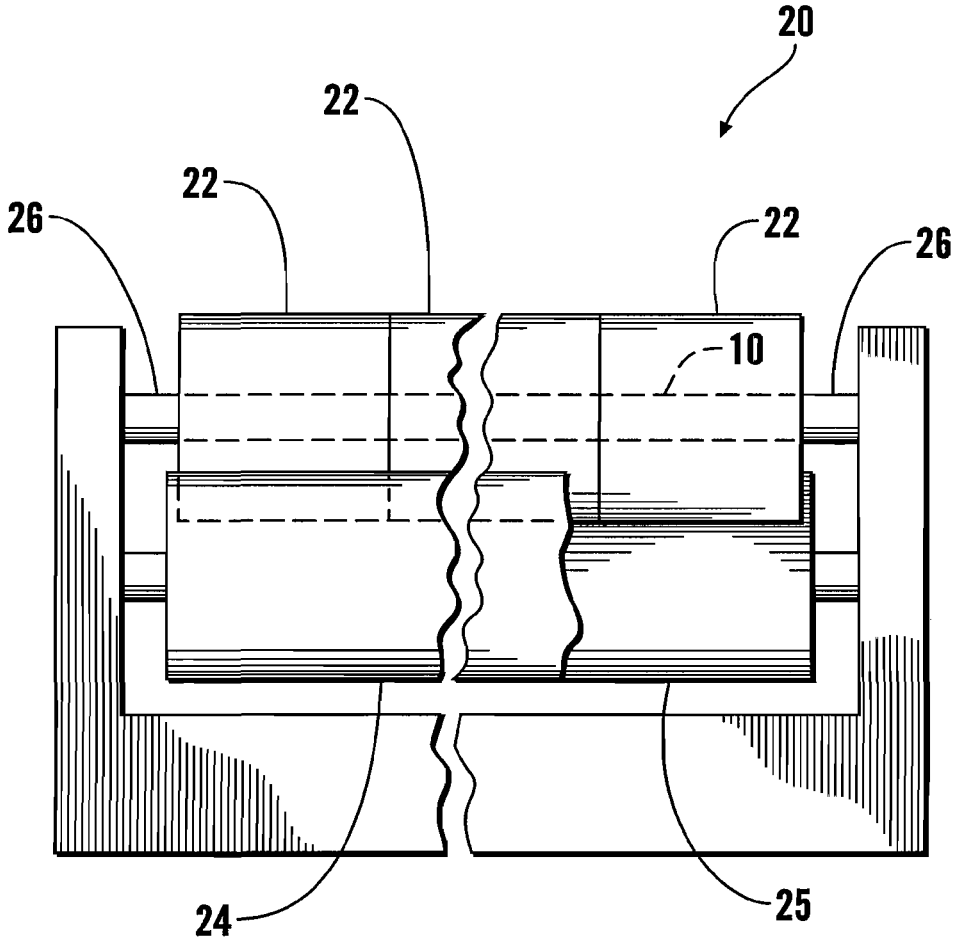
FIG. 3 is a schematic view of a two-drum type winder with core chucks engaging winding core ends.

In the following figures, the parts corresponding to one another have been designated by the same reference numerals. In the two-drum winder 20, shown schematically in FIG. 3, narrower component webs are slit with slitter blades from a web unwound from a machine reel and are wound into customer rolls 22 placed side by side on two winding drums 24, 25. The rolls 22 are formed on winding cores 10. Core chucks 26 engage the winding core ends. As shown in the figures, a cut 12U that deviates from a perpendicular cutting line has been made in one end 11A of a winding core, or a roll core 10, which cut 12U is placed against an end 11B of a roll core 10, as a mating cut 12N, situated against it in end-to-end relationship, thereby forming, in a way, a male grooving 12U and a female grooving 12N, which couple the ends 11A, 11B of the roll cores 10 to each other such that their center lines of rotation remain on the same line during the time of winding.

In the exemplifying embodiment shown in FIG. 1A, the severing cuts 12U, 12N which deviate from perpendicular have been made as a broken line in which the male and female groovings 12U, 12N conform directly to each other, thus coupling together the ends 11A, 11B of the roll cores 10 placed against each other.

Figures 1B, 1C, 1D:
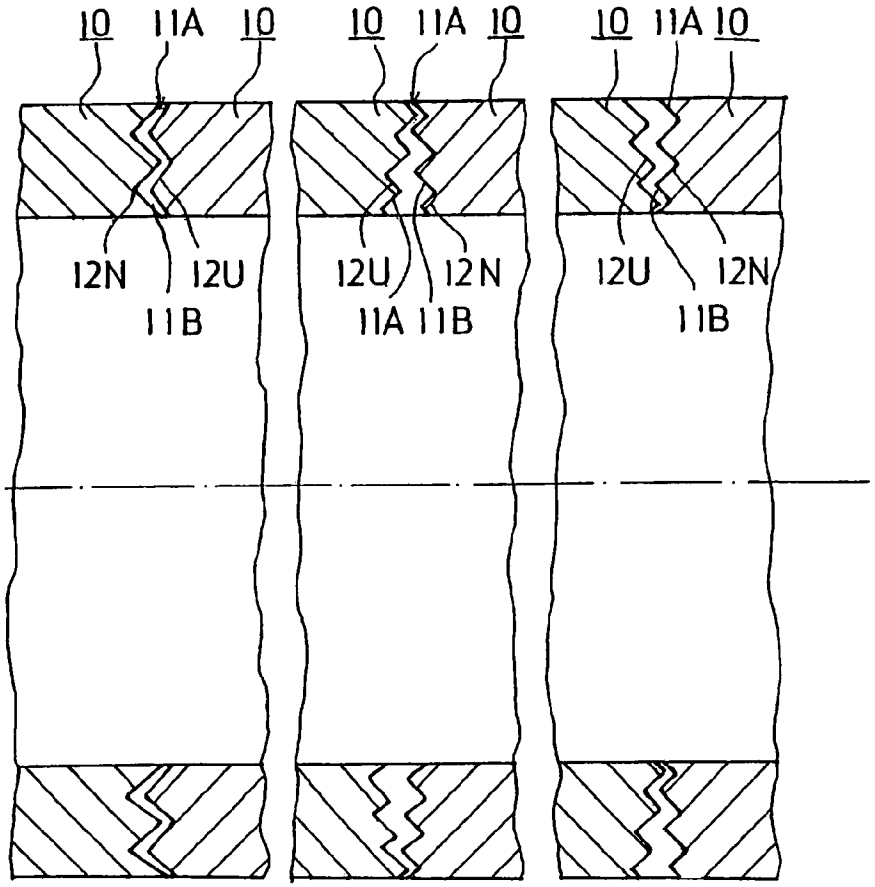

FIG. 1B shows an arrangement in which the severing cut shape 12N of the end 11A of one roll core 10 has been made deeper than the severing cut shape 12U of the end 11B of the other roll core 10, which end 11B is placed against the first-mentioned end 11A, i.e. the female grooving 12N has been made deeper than the male grooving 12U, thereby providing allowance for longitudinal yielding in accordance with an advantageous embodiment, which allowance makes it possible to compensate for the elongation of the roll cores 10 that occurs during winding.

FIGS. 1C and 1D show an arrangement in which the severing cuts 12U, 12N in accordance with the invention have been formed into groovings 12U, 12N such that the main direction of the grooving 12U in the end of at least one roll core 10 is oblique towards the center line of the roll core 10, thereby providing more distance for yielding, i.e. when the roll cores 10 elongate during winding.

Figure 2:
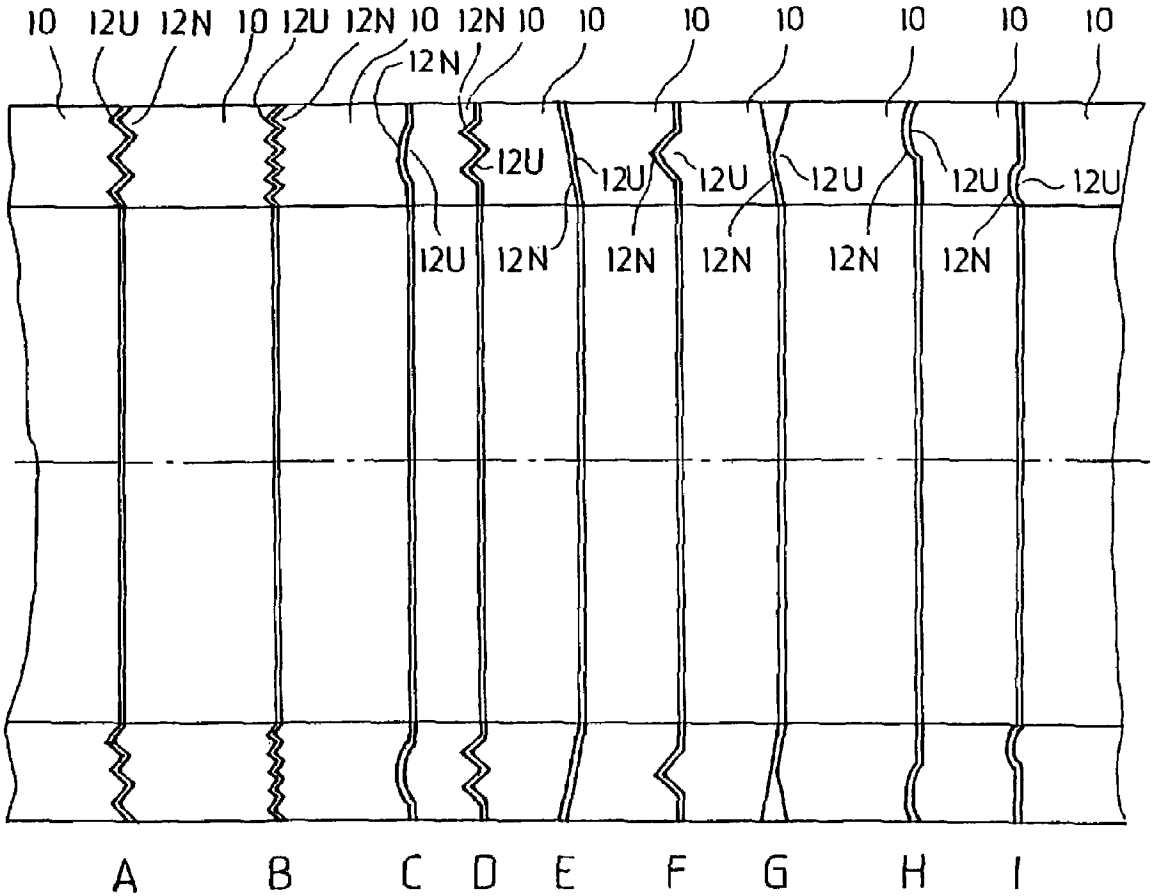
FIG. 2 shows further different additional alternatives.

The example A of FIG. 2 shows an embodiment in which the severing cuts 12U, 12N used form a serrated grooving.

The example B of FIG. 2 comprises a serrated grooving 12U, 12N with finer teeth as compared with the example A.

The example C of FIG. 2 shows an embodiment which uses a curve-shaped severing cut as the severing cut shapes 12U, 12N.

The example D of FIG. 2 shows one advantageous exemplifying embodiment in which the groovings 12U, 12N have been accomplished by means of two grooves and two tongues, longitudinal adjustment being accomplished by means of a greater groove depth of one grooving 12N.

The example E of FIG. 2 shows an embodiment in which the coupling of roll cores 10 to each other is accomplished by means of oblique severing cuts 12U, 12N.

The example F of FIG. 2 has been accomplished by means of one groove-and-tongue broken-line-shaped severing cuts 12U, 12N.

The example G of FIG. 2 shows an embodiment in which an oblique severing cut, i.e. an oblique surface 12N, has been combined with one tongue-shaped cut 12U. The examples H and I of FIG. 2 show wavy line types of severing cuts 12U, 12N, which have been accomplished using one groove-and-tongue shape 12N, 12U placed at different locations in the ends of the roll core 10. Of course, the wavy line may also extend over the entire area of the end cut of the roll core.

The cutting lines described above and other possible cutting lines in accordance with the different embodiments of the invention, which cutting lines deviate from perpendicular, can be accomplished such that in one end 11A of each roll core 10 there is a cut 12U of the male type and in the other end a cut 12N of the female type or such that roll cores 10 are used which have male cuts 12U and female cuts 12N, respectively, in both ends and the location of these roll cores 10 in the winder is alternated.

Above, the invention has been described only with reference to some of its advantageous exemplifying embodiments, but the invention is by no means meant to be narrowly limited to the details of them.

The invention claimed is:

1. A method for winding a paper, board or material web, comprising the steps of:

winding simultaneously a plurality of separate rolls, each of the plurality of rolls having a winding core, the winding cores forming a plurality of adjacent abutting winding cores having roll ends placed against each other, the ends formed by severing cuts which deviate from a plane perpendicular to an axis defined by each winding core, the cut end structure of at least one winding core abutting the cut end structure of an adjacent winding core, said abutting cut end structures being different in shape and not fully corresponding to each other;

wherein the winding cores and the separate rolls formed thereon are positioned side by side supported on at last two winder drums;

coupling the winding cores so that the axis defined by each winding core is aligned along a common axis of rotation during winding, by the roll ends placed against each other;

loading the core ends against one another by core chucks arranged in connection with a first free end and a second free end of outermost winding cores, so that the winding core ends placed against each other are loaded longitudinally; and causing the winding cores to extend longitudinally by winding simultaneously the plurality of separate rolls; and as the web is wound on the winding cores, yielding longitudinally, portions of the winding cores ends formed by the severing cuts, said portions of the winding cores ends formed by the severing cuts having a profile of a depth and shape which do not fully correspond to each other so as to yield longitudinally, thus providing axial play between the winding cores.

2. The method of claim 1, wherein the ends formed by severing cuts comprise separate pieces attached to portions of the winding cores.

3. The method of claim 1, wherein portions of the winding core ends are grooved to define male grooving and female grooving, such that when the ends of the winding cores are placed against one another in end-to-end relationship in the step of loading the core ends against one another, there is male grooving and female grooving engaged against each other.

4. The method of claim 1 wherein the longitudinal yielding is between 0.5-2 mm.

5. A winder for a paper, board or material web, comprising:

a two-drum type winder having at least one drum;

a plurality of adjacent winding cores mounted and supported on the at least one drum of the winder, the winding cores defining axes, and having roll ends placed against each other, the ends formed by severing cuts which deviate from a plane perpendicular to the winding core axes to define broken severing cuts, the plurality of winding cores being in receiving relation to a slit component of the web, the plurality of winding cores defining outermost winding cores having free ends;

a core chuck engageable with each of the free ends of the outermost winding cores so as to keep the winding cores placed one after the other in place one against the other; and wherein the winding core ends placed against each other are coupled to each other by the severing cuts, and wherein the broken severing cuts of the ends placed against each other do not fully correspond to each other and have a shape dimensioned such that there remains allowance for longitudinal yielding between the winding core ends.

6. The winder of claim 5, wherein the severing cuts are separate pieces attached to the ends of the winding cores.

7. The winder of claim 5 wherein portions of the winding core ends are grooved such that mating ends formed between adjacent winding cores include a male grooved end and a female grooved end engaged against each other.

8. The apparatus of claim 5 wherein the allowance for longitudinal yielding is between 0.5-2 mm.

9. A method for winding a paper, board or material web, comprising the steps of:

winding simultaneously a plurality of separate rolls, each of the plurality of rolls having a winding core, the winding cores forming a plurality of adjacent abutting winding cores having roll ends placed against each other, the ends formed by severing cuts which deviate from a plane perpendicular to an axis defined by each winding core;

wherein the winding cores and the separate rolls formed thereon are positioned side by side supported on at last two winder drums;

coupling the winding cores so that the axis defined by each winding core is aligned along a common axis of rotation during winding, by the roll ends placed against each other;

loading the core ends against one another by core chucks arranged in connection with a first free end and a second free end of outermost winding cores, so that the winding core ends placed against each other are loaded longitudinally; and causing the winding cores to extend longitudinally by winding simultaneously the plurality of separate rolls; and as the web is wound on the winding cores, yielding longitudinally, portions of the winding cores ends formed by the severing cuts, said portions of the winding cores ends formed by the severing cuts having a profile of a depth and shape so as to yield longitudinally, thus providing axial play between the winding cores;

wherein portions of the winding core ends are grooved to define male grooving and female grooving, such that when the ends of the winding cores are placed against one another in end-to-end relationship in the step of loading the core ends against one another, there is male grooving and female grooving engaged against each other; and wherein each winding core has a first end with the male grooving formed therein, and a second end with the female grooving formed therein, and wherein the male grooving and the female grooving do not fully correspond to each other so that grooves on the winding core first ends are unequal in depth to grooves on the winding core second sides, thereby providing axial play when the male grooving and female grooving engage against each other.

* * * * *